US008151889B2

(12) United States Patent
Biddick

(10) Patent No.: US 8,151,889 B2
(45) Date of Patent: Apr. 10, 2012

(54) SYSTEM AND METHOD FOR CONTROLLING FLOW IN A WELLBORE

(75) Inventor: David James Biddick, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/329,802

(22) Filed: Dec. 8, 2008

(65) Prior Publication Data

US 2010/0139923 A1 Jun. 10, 2010

(51) Int. Cl.
*E21B 34/06* (2006.01)

(52) U.S. Cl. ..... 166/332.8

(58) Field of Classification Search ..... 166/332.8; 251/663.6

See application file for complete search history.

(56) References Cited

U.S. PATENT DOCUMENTS 4,134,455 A * 1/1979 Read ..... 166/334.1
4,407,329 A * 10/1983 Huebsch et al. ..... 137/629
4,977,957 A 12/1990 Pringle
5,145,005 A * 9/1992 Dollison ..... 166/332.8
6,273,187 B1 8/2001 Voisin
6,302,216 B1 10/2001 Patel
6,315,047 B1 11/2001 Deaton
6,321,845 B1 11/2001 Deaton
6,433,991 B1 8/2002 Deaton
6,513,594 B1 2/2003 McCalvin
7,537,062 B2 * 5/2009 Hughes et al. ..... 166/386
2002/0108747 A1 8/2002 Dietz
2005/0056429 A1 3/2005 Du
2006/0021757 A1 2/2006 Patel
2006/0076149 A1 4/2006 McCalvin
2006/0086509 A1 4/2006 McMillan
2006/0096648 A1 * 5/2006 Guerrier ..... 137/875
2006/0162939 A1 * 7/2006 Vick et al. ..... 166/386
2007/0137869 A1 6/2007 MacDougall
2007/0158082 A1 * 7/2007 Williamson ..... 166/386
2007/0204999 A1 * 9/2007 Cowie et al. ..... 166/368
2007/0251696 A1 11/2007 Parks
2007/0284118 A1 12/2007 Benton
2008/0035353 A1 * 2/2008 Hughes et al. ..... 166/386
2008/0053662 A1 * 3/2008 Williamson et al. ..... 166/381
2008/0236842 A1 10/2008 Bhavsar
2009/0242206 A1 * 10/2009 Goughnour et al. ..... 166/332.8

* cited by examiner

*Primary Examiner* — William P Neuder

(57) ABSTRACT

A technique enables control over flow in a wellbore with a flow control system. In some cases, the flow control system may comprise a flapper device, an isolation assembly, and an actuation assembly. The flapper device may be configured to rotate within an approximate angular range from 15° to 75° when shifting between an open and closed state. In some situations, the engaging member may contain a profiled end configured to increase the moment applied to the flapper device during opening and control the rate of closure of the flapper device. The limitation to the angular range of the flapper device may reduce the loading forces that would otherwise act against the flow control system upon closure of the flapper device.

20 Claims, 4 Drawing Sheets

SYSTEM AND METHOD FOR CONTROLLING FLOW IN A WELLBORE

BACKGROUND

In many well related operations, appropriate well equipment is moved downhole to control fluid flow. For example, various completions are used to facilitate and control the flow of fluid in both production operations and injection operations. Valves are sometimes used to inhibit or otherwise control flow of fluid through the well equipment.

In some applications, detrimental reverse flow can be a problem and valves have been used to prevent flow in the undesirable direction. Flapper valves, for example, have been used to enable flow through tubing in one direction while blocking flow in the opposite direction.

For example, many subsurface safety valves utilize a flapper as a closure mechanism fitted within a body or housing member to enable control over fluid flow through a primary longitudinal bore upon an appropriate signal from a control system. The signal typically is a rapid reduction of the hydraulic operating pressure that holds the valve open, thereby facilitating shut-in of the production or injection flow. The closure mechanism typically is movable between the full closed and full open positions by movement of a tubular device, often called a flow tube. The flow tube can be moved to the open position or operated by the valve actuator which is motivated by hydraulics, pressure, electronics, or other external signal and power sources. The shifting of the flow tube to a closed position typically is performed by a mechanical power spring and/or a pressurized accumulator that applies a required load to move the flow tube to the closed position upon interruption of the "opening" signal. As a result, the valve may occasionally be required to close against a moving flow stream in the performance of its designed function. However, this action can subject the valve to substantial loading forces.

SUMMARY

In general, the present invention provides a system and method for controlling flow in a wellbore. A flow control system may comprise a closure member comprising a flapper device pivotally mounted at an angle of less than 90° to the central axis of the wellbore, and a flow tube, configured to open and close the flapper device of the closure member.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
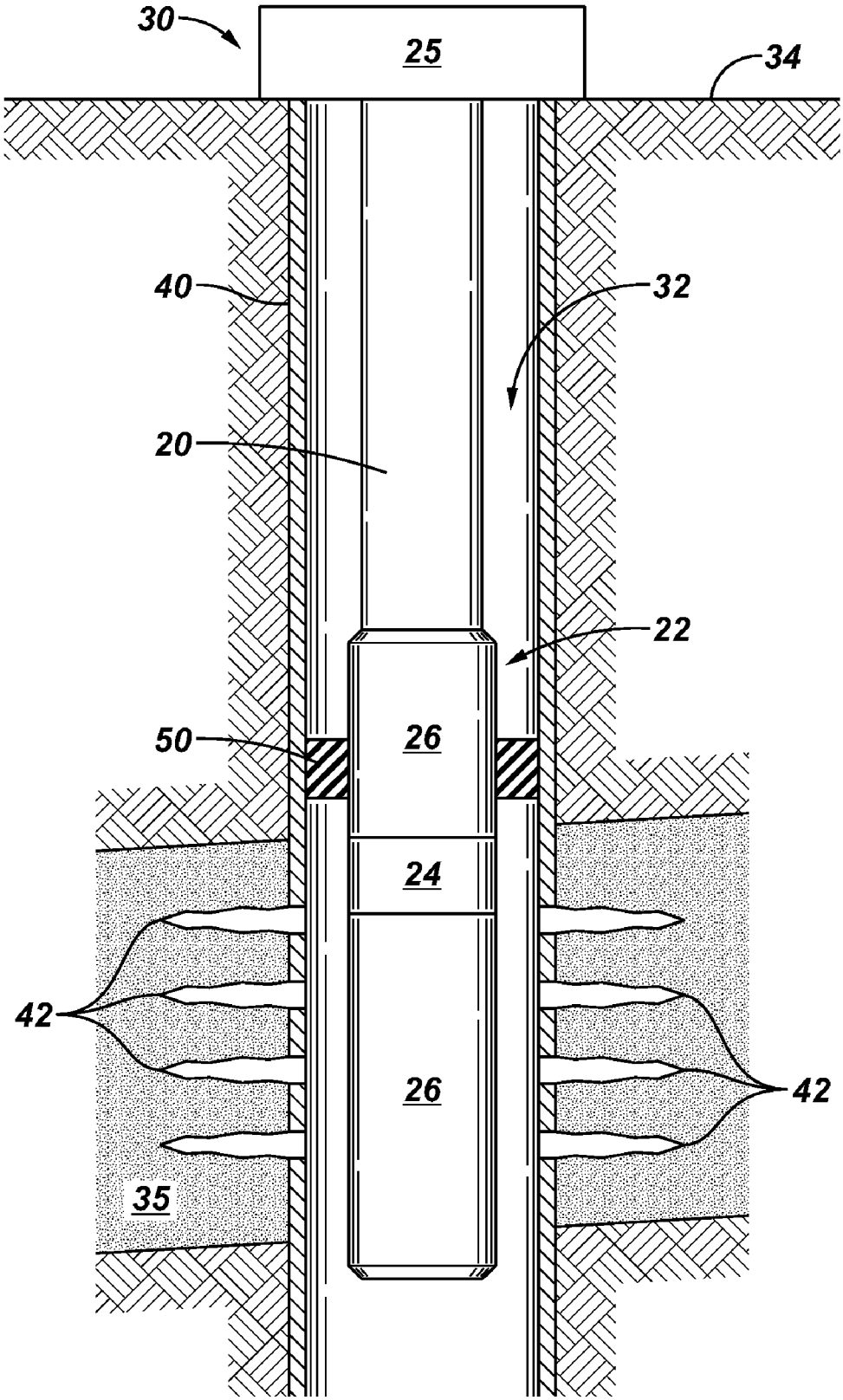
FIG. 1 is a front elevation view of a well assembly having a flow control system deployed in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible. In the specification and appended claims: the terms "connect", "connection", "connected", "in connection with", "connecting", "couple", "coupled", and "coupling" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention.

The present invention generally relates to a flow control system used to control material flow in a wellbore. For example, the flow control system may comprise a closure member. The closure member may comprise a flapper device pivotally mounted to abut and seal against a flapper seat. The flapper device and flapper seat may be configured such that the closure member transitions between an opened and closed state while the flapper device pivots through an angular range, for example, but not limited to approximately 15° to 75° plus or minus 5°. The flow control system may further comprise a flow tube configured to open and close the closure member. The flow control system may be used in a variety of well related operations. For example, the flow control system may be used in production and/or injection operations.

Generally, reducing the angular range of motion of the flapper device as the closure member transitions between an opened and closed state reduces the potential dynamic loads acting on the closure member and enhances the ability of the closure member to close and seal effectively. In production applications, this may allow the use of higher production rates without a potentially adverse decrease in the reliability or effectiveness of the flow control system. For example, the dynamic loading, such as the loading on a pivot coupling the flapper device to a housing or wellbore, or the loading between the flapper device and the flapper seat as the flapper device impacts and seals against the flapper seat, may be reduced due to the reduction in the range of motion of the closure member.

As a result, the flow control system is useful to prevent uncontrolled well flows for example. The flow control system also enables higher flow rates and provides protection in wells having flow rates that can be potentially damaging to flow control devices during emergency closures, for example. Additionally, the flow control system may be mounted with a variety of methods such as casing mounted, tubing mounted, or wireline mounted for example. However, the flow control system is not to be limited for use as a safety valve or to prevent uncontrolled well flows, any application requiring a directional closure in either direction though a well bore may incorporate a flow control system.

Referring generally to FIG. 1, one embodiment of a well system is illustrated as utilizing a flow control system that comprises a closure member and flow tube configured to reduce loading on the corresponding flapper device and flapper seat. In this embodiment, a well system 30 comprises a well equipment string, such as a completion string 22, deployed in a wellbore 32 via a conveyance 20. The wellbore 32 is drilled into a subsurface formation 35 that may contain desirable production fluids, such as petroleum. In the example illustrated, wellbore 32 is lined with a casing 40. The casing 40 typically is perforated to form a plurality of perforations 42 through which fluid can flow from formation 35 into wellbore 32 during production or from wellbore 32 into formation 35 during an injection operation.

In the embodiment illustrated, completion 22 and conveyance 20 comprise an internal fluid flow passage along which fluid potentially can flow downhole and/or uphole, depending on the operation being conducted. In most applications, completion 22 is formed as a tubular and may comprise a variety of components 26 depending on the specific operation or operations that will be performed in wellbore 32. A flow control system 24 is positioned to enable control over flow through completion 22 or along other fluid flow paths routed through a variety of wellbore tubulars or other fluid conducting components. In the embodiment illustrated, flow control system 24 may be coupled to components 26 of completion 22. Completion 22 also may utilize one or more packers 50 positioned and operated to selectively seal off one or more well zones along wellbore 32 to facilitate production and/or injection operations.

As illustrated, wellbore 32 is a generally vertical wellbore extending downwardly from a wellhead 25 disposed at a surface location 34. However, flow control system 24 can be utilized in a variety of vertical, multi-lateral and deviated, e.g. horizontal, wellbores to control flow along tubulars positioned in those wellbores. Additionally, the wellbore 32 can be drilled in a variety of environments, including subsea environments. Regardless of the environment, flow control system 24 is used to provide greater control over flow and to enable fail safe operation.

Figure 2A:
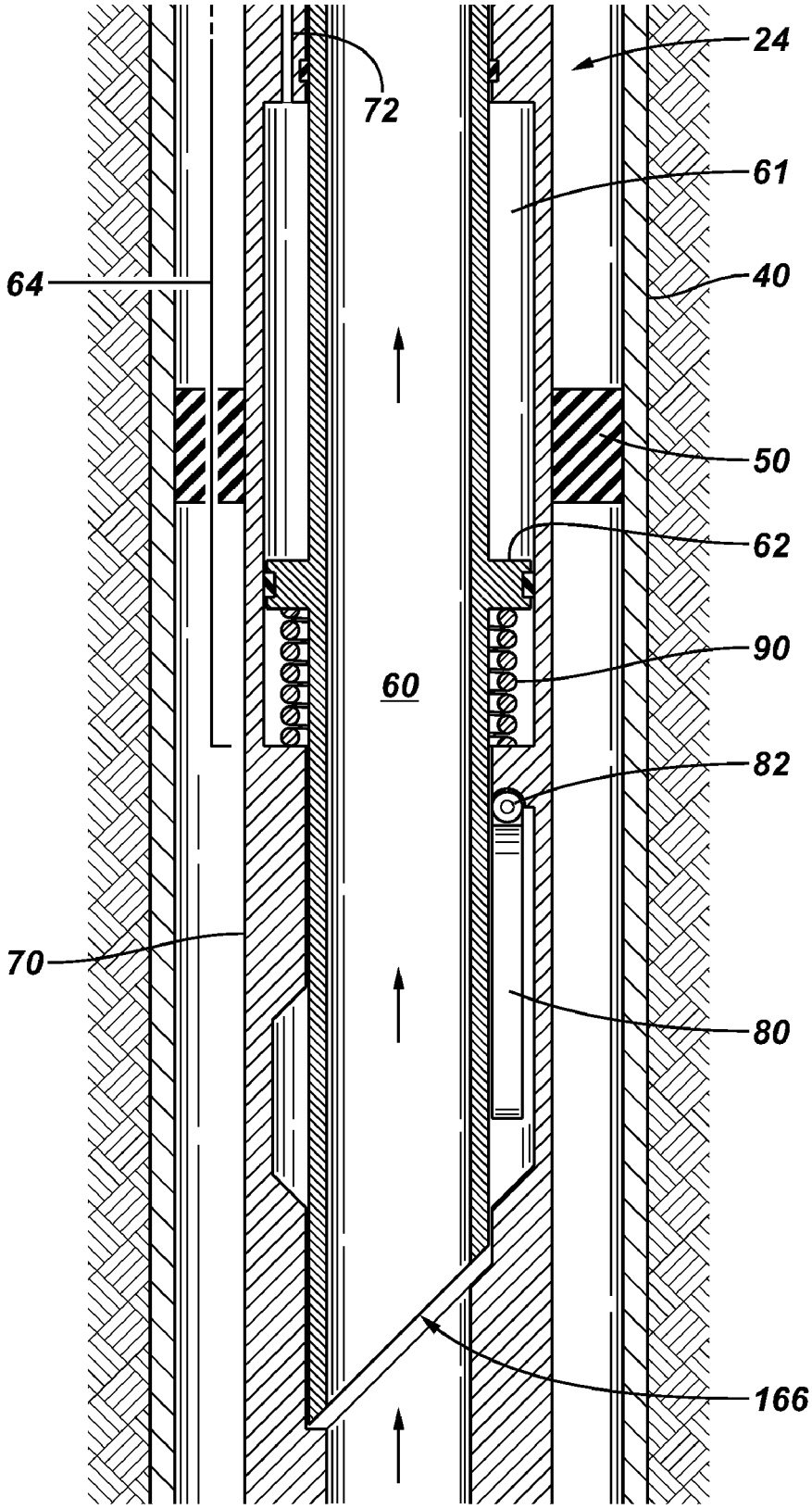
FIG. 2A is a partial cross-sectional view of a flow control system that may be used in the well assembly of FIG. 1, while in an open configuration, according to an embodiment of the present invention.
Figure 2B:
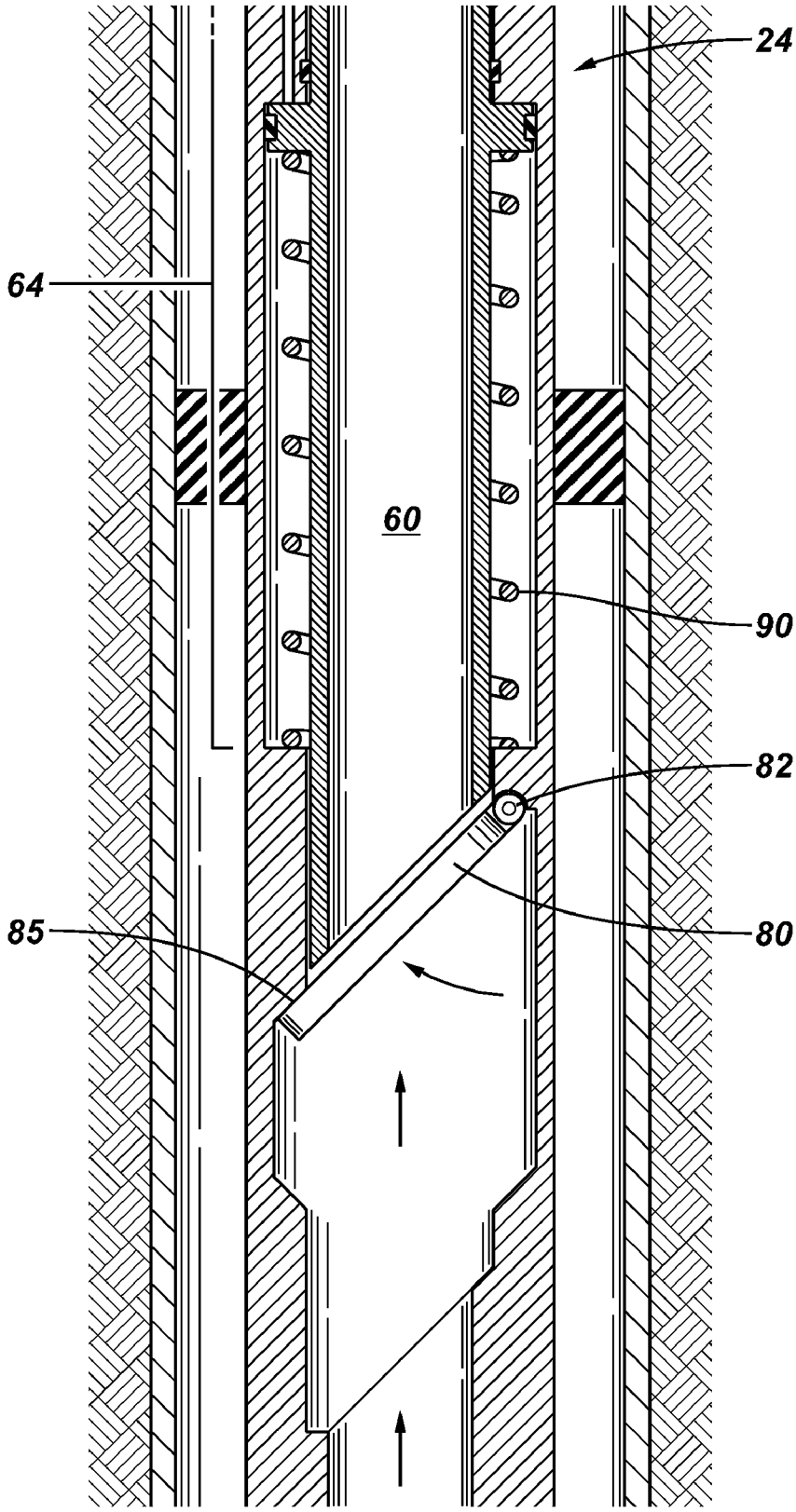
FIG. 2B is an enlarged partial cross-section view of a flow control system similar to the system illustrated in FIG. 2A, but showing the flow control system shifted to a closed configuration, according to an embodiment of the present invention.

Referring generally to FIGS. 2A and 2B, one simplified example of a flow control system 24 is illustrated as deployed in a tubular structure 70 that may be part of completion 22 (see FIG. 1). In the portion of the completion 22 shown, the tubular structure 70 is mounted within a casing 40. The annulus between the casing 40 and the tubular structure 70 may be sealed through the use of a packer 50. Of course, embodiments of the present invention may not be limited to this illustrative configuration. Embodiments of the present invention may incorporate and/or interact with a variety of types and configurations of completions and downhole tools.

In the embodiment illustrated, flapper device 80 is pivotably mounted in the tubular structure 70 via a pivot connection 82. The flapper device 80 may be moved between an open and closed position by an engaging member 60 (e.g., such as a flow tube, control rod, lever, among others). FIG. 2A illustrates an opened position and FIG. 2B illustrates a closed positioned. Tubular structure 70 and engaging member 60 may each form a central bore configured to allow fluid flow between the formation 35 and the surface 34. Production fluid may flow through this central bore in the direction of the arrow from the formation 35 to the wellhead 25 (see FIG. 1).

The engaging member 60 may comprise an angled, profiled, or contoured end 62 used to abut against a surface of the flapper device 80 (an angled end is shown in this exemplary embodiment). In some cases, a control rod or lever may interact with a corresponding member of the flapper device 80, thereby opening and closing the flapper device 80. The engaging member 60 may be actuated by an actuation assembly 64. The actuation assembly 64 may comprise a piston 62 configured to slidingly interact with an interior surface of the tubular structure 70. A hydraulic chamber 64 may be formed on one side of the piston 62 and configured to allow hydraulic fluid to enter through an orifice 72. The orifice 72 may be further attached to a control line (not shown). By increasing pressure in the hydraulic chamber 64 via the control line, the actuation assembly 64 may apply a downward force on the engaging member 60. Accordingly, the engaging member 60 may be positioned and maintained such that the flapper device 80 is held open and generally isolated from the central bore of the tubular structure.

In some cases, the actuation assembly 64 may comprise a rod and piston assembly. In other cases, the actuation assembly 64 may be an electromechanical assembly, for example, comprising a solenoid or motor along with a means for communication, such as via pressure, acoustic, or electrical communications.

The actuation assembly 64 may further comprise a stored energy assembly 90, such as a coil or gas spring (a coil spring is shown in the illustrative embodiment). The stored energy assembly 90 may apply a force to the engaging member 60 in a direction opposing the force applied by the hydraulic pressure. Accordingly, the stored energy assembly 90 in some cases may apply a closing force to the engaging member 60. As long as the hydraulic force exceeds the force of the stored energy assembly 90, the engaging member 60 may hold the flapper device 80 in an opened position. When the hydraulic force drops below the force of the stored energy assembly 90 (e.g., such as when the control line is unintentionally severed, or when a well operator desires to shut off flow through the engaging member 60), the engaging member 60 may be moved to a position at which the flapper device 80 is allowed to close off the flow through the tubular structure 70 (e.g., as shown in FIG. 2B).

Referring generally to FIG. 2B, this figure illustrates an engaging member 60 in a closed position. The actuation assembly 64 has interacted with the engaging member 60 in order to close off access to the central bore of the engaging member 60 and tubular structure 70. In the position shown, flapper device 80 has rotated about pivot connection 82 in the direction of the arcuate arrow. The flapper device 80 may be biased or urged to move in this direction due to another stored energy member, such as a hinge spring (not shown). The other stored energy member may interact with the flapper device 80 and the tubular structure 70. In addition, the direction of fluid flow (as indicated by the straight arrow) may also contribute to a closing force of the flapper device 80.

The rotational range of the flapper device 80 may be approximately from 15° to 75°, for example, plus or minus 5° (e.g., the range shown in FIG. 2B is approximately 45°) between the opened and closed positions. Preferably, the rotational range may be less than 60°. At one end of the range, the flapper device 80 may abut and seal with a flapper seat 85. At the other end of the range, the flapper device 80 may abut against the tubular structure 70 (see FIG. 2A).

The components of flow control system 24 can be designed in a variety of configurations. For example, actuation assembly 64 may comprise a hydraulic piston, an electromechanical device, a gas-piston coupled with a hydraulic system, or other devices that may be selectively actuated to move isolation assembly 68. The actuation assembly 64 also can be designed to operate under the influence of flow directed downhole or via a shifting tool run on slick line or wire line. Depending on the design of actuation assembly 64, a control line to the actuation assembly 64 may comprise a hydraulic control line, an electric control line, an optical control line, a wireless signal receiver, or other suitable devices for providing the appropriate signal to actuation assembly 64. Additionally, stored energy assembly 90 may comprise a variety of devices, such as one or more springs. By way of example, stored energy assembly 90 may comprise one or more coil springs, gas springs, wave springs, power springs or other suitable springs able to store energy upon movement of engaging member 60 via actuation assembly 64. Depending on the requirements of a given application, the orientation of the stored energy assembly 90 can be selected to hold the device in a normally closed or normally open position. In alternative embodiments, stored energy assembly 90 could be replaced with a second control line, e.g. a second hydraulic line, to cause movement of engaging member 60 back to its previous position.

The engaging member 60 may be designed to cooperate with the flapper device 80 in a manner that enables selective shifting of the flapper device 80 between open and closed positions. For example, the engaging member 60 may comprise a tubular member positioned to move into flapper device 80 and to pivot the flapper device 80 to an open position. It should be noted that engaging member 60 can be designed in a variety of configurations. In an alternate embodiment, the illustrated engaging member 60 can even be replaced with levers or other mechanisms configured to open and close the flapper device 80 or other closure elements. In still other embodiments, engaging member 60 can be actuated by fluid velocity or wellhead pressure.

Modifications in the various assemblies of flow control system 24 (see FIG. 1) can be adopted according to overall system design requirements and environmental factors. For example, individual or multiple flapper devices 80 can be utilized in a variety of shapes and sizes, and the flapper elements can be deployed at single or multiple locations along the wellbore tubular. Additionally, the stored energy systems and isolation systems can be changed according to the overall design of the flow control system 24, completion 22, and/or well system 30. Furthermore, control signals can be supplied to actuation assembly 64 from a surface location or from a variety of other locations at or away from the well site. In some cases, control signals may be supplied from a subsea location, such as via a subsea tree. The control signals can be carried by a variety of wired or wireless control lines as required by the actuator assembly to enable selective shifting of the flow control system 24 from one configuration to another.

Various features and components can be integrated into or used in conjunction with the flow control system 24. For example, the flapper device can incorporate internal self-equalizing components to equalize pressures above and below a closed flapper device. The flapper device also may comprise an internal profile with sealing capability to enable acceptance of through-tubing accessories, such as plugs, flow measurement tools, lock mandrels, and other accessories. In some embodiments, the flow control system 24 may incorporate a locking mechanism that can be actuated to either temporarily or permanently lock the flow control system in an open state to facilitate removal of components, installation of components, and other service operations.

Other examples of components that can be used with the flow control system 24 include dynamic or static mechanisms positioned to prevent debris from entering portions of the flow control system 24 that would interfere with the function of the closure members. In some applications, the flow control system 24 may be constructed with a body having an eccentric design to optimize the inside diameter to outside diameter relationship. A variety of chemical injection systems also can be incorporated with the flow control system to enable selective injection of chemicals during service operations or other downhole operations. The flow control system 24 can further incorporate mechanisms that enable selective mechanical actuation of the system if necessary.

Figure 3A:
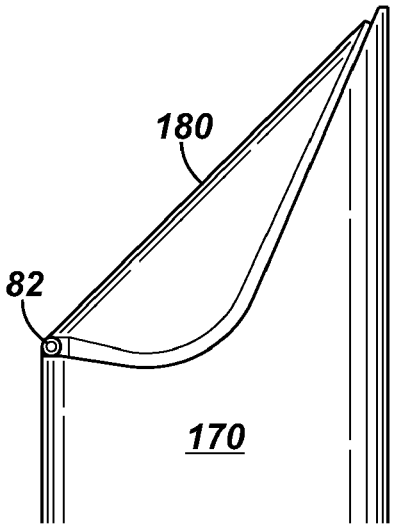
FIG. 3A is a front elevation view of another example of a flapper device and associated components that may be used in a flow control system, while in a closed configuration, according to another embodiment of the present invention.
Figure 3B:
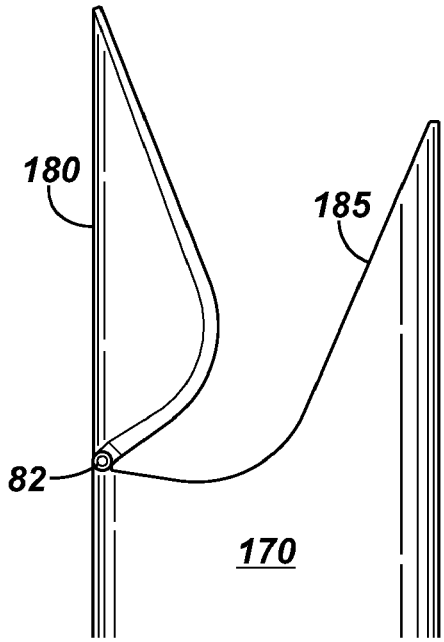
FIG. 3B is a front elevation view of the flapper device and associated components illustrated in FIG. 3A, but showing the components shifted to an open configuration, according to an embodiment of the present invention.

Referring generally to FIGS. 3A and 3B, these drawings illustrate another exemplary embodiment of the flapper device 80 shown in FIGS. 2A and 2B. As shown in FIGS. 3A and 3B, flapper device 180 comprises an arcuate configuration designed to conform to the general circumference of the attached tubular structure 170. Flapper device 180 may be pivotally coupled to the tubular structure 170 via a pivot 82 (e.g., such as a pin, among others). Angular rotation of the flapper device 180 between an opened and closed state may be an angle in an approximate range from 15° to 75°. As more easily seen in FIG. 3B, the flapper seat 185 is configured to conform to the periphery of the flapper device 180.

Figure 4:
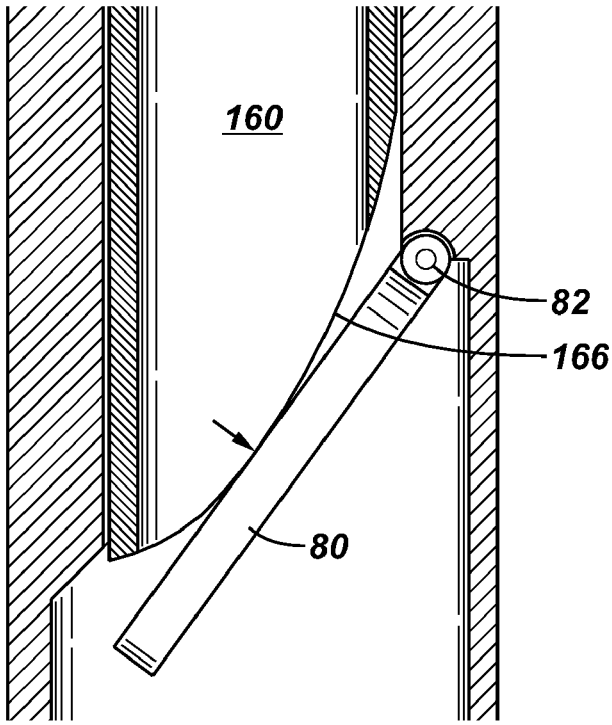
FIG. 4 is a partial cross-sectional view of another example of an isolation assembly and associated components that may be used in a flow control system, according to an embodiment of the present invention.

Turning generally to FIG. 4, this drawing illustrates another exemplary embodiment of the engaging member 60 of FIGS. 2A and 2B. As shown in FIG. 4, the end of the engaging member 160 may comprise an arcuate profile 166. The arcuate profile 166 may be configured to contact a surface of the flapper device 80 during shifting between opening and closing the flow control system 24 (see FIG. 1). The arcuate profile 166 may be configured such that the point of contact (e.g., as represented by the arrow) moves toward the pivot 82 during opening and away from the pivot 82 during closing of the flapper device 80.

For example, the profile shown may apply the greatest moment to the flapper device 80 during the time that the flapper device 80 is opening against potential pressure resulting from well flow. Additionally, the arcuate profile 166 of the engaging member 160 may also control the rate of closure of the flapper device 80 and inhibit or prevent the build up of a large dynamic loading otherwise resulting from closing of the flapper device 80 during an emergency situation (e.g., such as shutting off production flow in the event of a well blow out).

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A flow control system for use in a wellbore, comprising:

a flapper device positioned in a well string at a desired location;

an engaging member having a profile configured to abut a surface of the flapper device and transition the flapper device between a first position and a second position, the profile of the engaging member having an arcuate form specifically selected to cooperate with the design of the flapper device to control transition of the flapper device during an emergency closure so as to inhibit large dynamic loading; and wherein the flapper device is configured to rotate through an angular range which is limited to less than 75° between the first position and the second position, the flapper valve being the sole device controlling fluid flow at the desired location between full flow and no flow conditions.

2. The flow control system as recited in claim 1, wherein the first position of the flapper device blocks flow along a fluid flow path.

3. The flow control system as recited in claim 1, wherein the engaging member comprises a flow tube.

4. The flow control system as recited in claim 1, wherein the engaging member is hydraulically actuated in at least one direction.

5. The flow control system as recited in claim 1, wherein the engaging member is electromechanically actuated in at least one direction.

6. The flow control system as recited in claim 1, further comprising a stored energy device to bias the engaging member in at least one direction.

7. The flow control system as recited in claim 1, further comprising a hydraulically powered piston to actuate the engaging member in at least one direction.

8. The flow control system as recited in claim 1, wherein the angular range is less than 60°.

9. The flow control system as recited in claim 1, wherein the angular range is 45°.

10. A flow control system for use in a well bore comprising:

a flapper device pivotally coupled to a tubular member to solely and selectively block a flow through the tubular member;

an engaging member configured to transition the flapper device between a first position blocking a fluid flow path and a second position providing access to the fluid flow path, the engaging member having a profile selectively matched with the flapper device so as to enable transition of the engaging member back to the first position while inhibiting large dynamic loading during an emergency closure;

an actuation assembly configured to transition the engaging member between a first position and a second position, the actuation assembly further comprising a stored energy assembly positioned to bias the engaging member against movement from the first position to the second position; and wherein an angular range defined between the first position and the second position of the flapper device is less than 75°.

11. The flow control system as recited in claim 10, wherein the actuation assembly comprises a hydraulic piston to transition the engaging member in a first direction.

12. The flow control system as recited in claim 11, wherein the stored energy device is configured to transition the engaging member from the second position to the first position upon a loss of hydraulic pressure.

13. The flow control system as recited in claim 10, wherein the engaging member comprises a flow tube and an arcuate profiled end configured such that a moment applied to the flapper device moves relative to a pivot point of the flapper device as the flapper device transitions between the first and the second position.

14. The flow control system as recited in claim 10, wherein a cross-section of the flapper device is substantially arcuate.

15. The flow control system as recited in claim 10, wherein a cross-section of the flapper device is substantially planar.

16. The flow control system as recited in claim 10, wherein the engaging member substantially covers the flapper device while the flapper device is in the first position.

17. The flow control system as recited in claim 10, wherein the angular range is less than 70°.

18. The flow control system as recited in claim 10, wherein the angular range is 45°.

19. A flow control system for use in a wellbore, comprising:

a flapper device pivotally coupled to a tubular member;

an engaging member configured to transition the flapper device between a first position blocking a fluid flow path and a second position providing access to the fluid flow path;

an actuation assembly coupled with the engaging member and configured to transition the isolation assembly between a first position and a second position;

wherein an angular range defined between the first position and the second position of the flapper device is less than 75°; and wherein the engaging member comprises a flow tube containing an arcuate profiled end as viewed in a side view in which the profiled end is configured to increase a moment applied to the flapper device by the engaging member as the flapper device is transitioned to the first position, the arcuate profiled end being selected to cooperate with the design of the flapper device in a manner enabling transition of the engaging member back to the first position while inhibiting large dynamic loading during rapid closure.

20. The flow control system as recited in claim 19, wherein the angular range is 45°.

* * * * *